US011027873B2

(12) United States Patent
McElhinney

(10) Patent No.: US 11,027,873 B2
(45) Date of Patent: Jun. 8, 2021

(54) STAMP APPLICATION

(71) Applicant: ALTRIA CLIENT SERVICES LLC, Richmond, VA (US)

(72) Inventor: Patrick McElhinney, Chesterfield, VA (US)

(73) Assignee: Altria Client Services LLC, Richmond, VA (US)

( * ) Notice: Subject to any disclaimer, the term of this patent is extended or adjusted under 35 U.S.C. 154(b) by 724 days.

(21) Appl. No.: 15/721,113

(22) Filed: Sep. 29, 2017

(65) Prior Publication Data

US 2019/0100342 A1 Apr. 4, 2019

(51) Int. Cl.

| | |
|---|---|
| ***B65C 1/02*** | (2006.01) |
| ***B65C 9/24*** | (2006.01) |
| ***B65C 9/18*** | (2006.01) |
| ***B65C 9/40*** | (2006.01) |
| ***B65C 9/02*** | (2006.01) |
| ***B65C 9/30*** | (2006.01) |
| ***B65C 9/42*** | (2006.01) |

(52) U.S. Cl.

CPC ..... *B65C 1/021* (2013.01); *B65C 9/02* (2013.01); *B65C 9/18* (2013.01); *B65C 9/1873* (2013.01); *B65C 9/24* (2013.01); *B65C 9/30* (2013.01); *B65C 9/40* (2013.01); *B65C 9/42* (2013.01)

(58) Field of Classification Search

CPC ..... B65C 1/021; B65C 9/1873; B65C 9/40; B65C 9/02; B65C 9/18; B65C 9/24; B65C 9/30; B65C 9/42

See application file for complete search history.

(56) References Cited

U.S. PATENT DOCUMENTS

| | | | | |
|---|---|---|---|---|
| 3,025,211 | A * | 3/1962 | Winn | B65C 9/1811 156/542 |
| 4,648,933 | A | 3/1987 | Graziano | |
| 4,664,740 | A | 5/1987 | Wilkinson | |
| 5,168,883 | A | 12/1992 | Winn | |
| 6,672,356 | B1 * | 1/2004 | Jenkins | B65C 1/021 156/350 |
| 6,878,222 | B1 | 4/2005 | Os | |
| 7,437,860 | B2 | 10/2008 | Brandow et al. | |
| 7,506,485 | B2 | 3/2009 | Quinn et al. | |
| 7,568,511 | B2 | 8/2009 | Chojnacki et al. | |
| 7,631,677 | B2 | 12/2009 | Chojnacki | |
| 8,201,604 | B2 | 6/2012 | Green et al. | |
| 8,408,271 | B2 | 4/2013 | Hussain et al. | |
| 9,440,759 | B2 * | 9/2016 | Reed | B65C 9/02 |
| 2007/0215263 | A1 | 9/2007 | Quinn et al. | |

(Continued)

FOREIGN PATENT DOCUMENTS

DE 19716651 A1 10/1998

OTHER PUBLICATIONS

International Search Report and Written Opinion for corresponding International Application No. PCT/US2018/052584 dated Jan. 25, 2019.

*Primary Examiner* — Jeffry H Aftergut

(74) *Attorney, Agent, or Firm* — Harness, Dickey & Pierce, P.L.C.

(57) ABSTRACT

A method and apparatus for applying stamps to a group of packages wherein the stamps are arranged in a predetermined pattern and the packages in the group are arranged in a different pattern, using an apparatus having one or more carriages moveable in the x- and/or y-directions.

35 Claims, 7 Drawing Sheets

(56) References Cited

U.S. PATENT DOCUMENTS

| | | | |
|---|---|---|---|
| 2009/0314413 | A1 | 12/2009 | Brandow et al. |
| 2010/0200159 | A1 | 8/2010 | Le |
| 2015/0274345 | A1 | 10/2015 | Fisher |
| 2016/0052659 | A1 | 2/2016 | Bowers et al. |

* cited by examiner

STAMP APPLICATION

FIELD

This invention relates to an apparatus and method providing the capability to apply tax stamps to unique pack sizes or unique pack configurations in cartons.

ENVIRONMENT

Various tax stamping machines have been proposed in the past for providing a process of applying stamps to one end of a cigarette pack. However, each of these machines has been designed for a particular size of a cigarette pack or pack configuration, and cannot be readily adapted or modified to handle product packs of a different width or length, such as a non-standard pack size, or different pack configurations.

States in the US require that tax stamps be applied to packs of cigarettes. Currently, tax stamps are produced on a roll. The rolls are applied to cigarette packs. "Standard" cigarette packs are approximately 21 to 24 millimeters wide and 52 to 60 millimeters long, with some variations, and are typically oriented into cartons in two rows of five packs. The rolls of tax stamps are generally produced and configured in a pattern that conforms to these standard cigarette packs and the corresponding arrangement of those packs in a carton to facilitate application of the stamps to the cigarettes packs. For certain non-standard product packs or arrangements that do not align with the patterns in the rolls of stamps, the packs may need to be hand-stamped. This is a very inefficient, costly and time consuming operation.

There remains an unmet need in the art to apply existing rolled tax stamps to non-standard packs, different pack configurations, carton arrangements, etc., in an automated way, particularly now that different type of smoking articles, packs and carton arrangements exist or may exist (such as, for example and without limitation, for e-vapor articles, heat-not-burn tobacco sticks, etc.), including some with different sizes, orientations and carton configurations compared to said standard cigarette packs and cartons.

SUMMARY

While certain embodiments herein may be capable of applying existing rolled tax stamps to non-standard pack sizes or carton arrangements, certain embodiments may also or alternatively be used with new configurations of rolled tax stamps, and/or with standard cigarette pack sizes and carton arrangements.

In one embodiment is presented an apparatus for affixing stamps unwound from a roll of stamps to a grouping of product packages, comprising a first carriage with a pair of rollers for holding the roll of stamps, a second carriage below the first carriage for holding the grouping of product packages, and a stamp applicator located above a portion of the unwound stamps, wherein the first carriage, the second carriage and the stamp applicator, alone or in combination, are structured and arranged to enable alignment of at least one stamp of the unwound portion of the roll of stamps in both x- and y-directions above and relative to at least one product package of the grouping of product packages, additional alignments occurring multiple times per grouping.

In another embodiment, the alignment acts to align the at least one stamp above the at least one product package in the grouping for application of the stamp to the product package.

In yet another embodiment, the first carriage is moveable in the y-direction and the second carriage is moveable in the x-direction, or wherein first carriage is moveable in the x-direction and the pair of rollers on the first carriage are structured and arranged to wind and unwind the roll of stamps to move the stamps in the y-direction, or wherein the first carriage is moveable in the x-direction and/or y-direction, or wherein the second carriage is moveable in the x-direction and/or y-direction.

In still yet another embodiment, the pair of rollers on the first carriage is structured and arranged to wind and unwind the roll of stamps to move the stamps in the y-direction and the second carriage is moveable in the x-direction.

In a further embodiment, the stamp applicator is provided on a third carriage which is moveable in the x-direction and/or y-direction, such as wherein the stamp applicator is moveable in the x direction.

In another embodiment, a pattern of the stamps on the roll varies from a pattern of the grouping of product packages.

In a further embodiment, the apparatus further comprises a controller programmed to control the position of at least one of the carriages and the stamp applicator in the x-direction and/or y-direction.

In still another embodiment, the grouping of product packages is inside a container or not inside a container.

In another embodiment, the second carriage is a conveyor that moves the grouping of product packages in the x-direction.

In yet another embodiment, the first carriage has first and second rollers to accommodate the roll of stamps, the roll of stamps comprising a two-dimensional array of stamps on a rolled flexible substrate in a first predetermined pattern, the first carriage moveable in an x-direction and/or y-direction, the second carriage is below the first carriage, the second carriage structured and arranged to move the first grouping of product packages in the x-direction and/or y-direction, and wherein the grouping of packages are arranged in a second pattern different than the first predetermined pattern of the stamps, a third carriage located above the first carriage and having at least one stamp applicator affixed thereto, the third carriage moveable in the x-direction, y-direction and/or z-direction, and a controller programmed to control the position of at least one of the carriages in the x-direction and/or y-direction, such that the at least one stamp applicator is aligned above a stamp on an unwound portion of the roll of stamps and the stamp is aligned above at least one package of the grouping of product packages.

In a further embodiment, the roll of stamps is a roll of wax tax stamps.

In one embodiment, the first and second rollers are both motorized and the controller is further programmed to control the motorized rollers, so as to wind and unwind the roll of stamps to move the stamps in the y-direction.

In another embodiment is disclosed a method of applying stamps to a grouping of product packages, comprising the steps of i) placing a roll of stamps which are arranged on a lower surface of a flexible substrate in a first predetermined pattern between rollers on a first carriage that is structured and arranged for movement in the x-direction and/or y-direction, ii) placing a grouping of product packages arranged in a second pattern different than the predetermined pattern of the stamps beneath an unwound portion of the roll of stamps, iii) aligning at least one of the stamps on the unrolled portion above a top surface of at least one product package of the grouping of product packages, iv) aligning at least one stamp applicator above the at least one stamp, v) contacting an upper surface of the flexible substrate above the at least one stamp with the at least one stamp applicator to press the at least one stamp into contact with the top surface of the at least one product package to apply the stamp to the top surface of the product package, and vi) repeating steps iii) to v) for additional stamps and additional product packages of the grouping of product packages.

According to this embodiment, the stamp applicator is affixed to a second carriage and the stamp applicator or the second carriage is structured and arranged for movement in at least the x-direction, independently of the first carriage.

In another embodiment, the method includes programming a controller with a recipe including information regarding the first predetermined pattern and the second pattern, to align the at least one stamp applicator over the at least one stamp and to align the at least one stamp over the top surface of at the least one product package.

In a further embodiment, the rollers are motorized and further comprising winding and unwinding the roll of stamps with the motorized rollers to move the stamps in the y-direction to enable the alignment of the at least one of the stamps above the top surface of the at least one package of the grouping of product packages.

In an additional embodiment, the method further comprises moving the second carriage in the x-direction and/or y-direction, or moving the first carriage and the second carriage in the x- and/or y-directions, or moving the first carriage in the x-direction and/or y-direction to align the at least one stamp applicator above the at least one stamp, or moving the container in the x-direction and/or y-direction to align the at least one stamp above the at least one product package, or moving the first carriage in the x-direction and winding or unwinding the roll of stamps to move the stamps in the y-direction with the motorized rollers to enable the alignments of steps iii) and/or iv).

BRIEF DESCRIPTION OF THE DRAWINGS

The forms disclosed herein are illustrated by way of example, and not by way of limitation, in the figures of the accompanying drawings and in which like reference numerals refer to similar elements and in which.

DETAILED DESCRIPTION

Figure 1A:
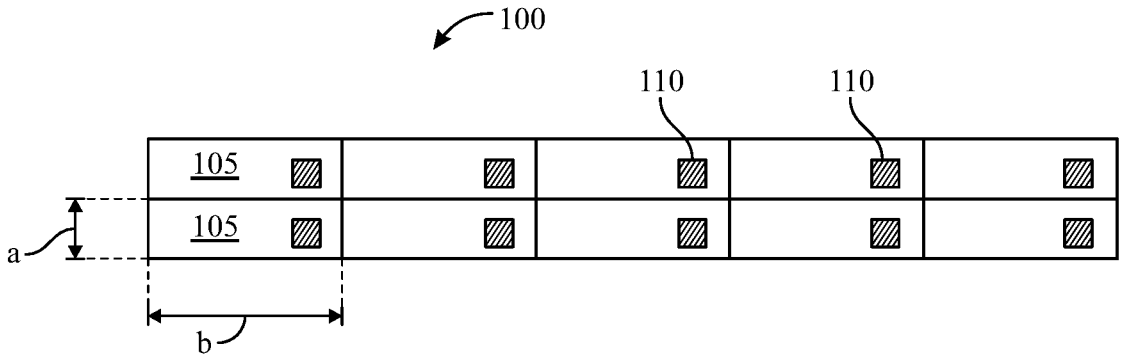
FIG. 1A presents an arrangement of standard packs.

Various aspects will now be described with reference to specific forms selected for purposes of illustration. It will be appreciated that the spirit and scope of the apparatus, system and methods disclosed herein are not limited to the selected forms. Moreover, it is to be noted that the figures provided herein are not drawn to any particular proportion or scale, and that many variations can be made to the illustrated forms. Reference is now made to the figures, wherein like numerals are used to designate like elements throughout.

Each of the following terms written in singular grammatical form: "a," "an," and "the," as used herein, refers to, and encompasses, one or more of the stated entity or object, unless otherwise specifically defined or stated herein, or, unless the context clearly dictates otherwise. For example, the phrases "a device," "an assembly," "a mechanism," "a component," and "an element," as used herein, refers to, and encompasses, one or more devices, one or more assemblies, one or more mechanisms, one or more components, and one or more elements, respectively.

Each of the following terms: "includes," "including," "has," "having," "comprises," and "comprising," and, their linguistic or grammatical variants, derivatives, and/or conjugates, as used herein, means "including, but not limited to."

The term "and/or" placed between a first entity and a second entity means (1) the first entity, (2) the second entity, or (3) both the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," will refer to the inclusion of exactly one element of a number or list of elements. In general, the term "or" as used herein shall be interpreted as indicating exclusive alternatives (i.e. "one or the other but not both") only when preceded by terms of exclusivity, such as "only one of," or "exactly one of".

Throughout the illustrative description, the examples, and the appended claims, a numerical value of a parameter, feature, object, or dimension, may be stated or described in terms of a numerical range format. It is to be fully understood that the stated numerical range format is provided for illustrating implementation of the forms disclosed herein, and is not to be understood or construed as inflexibly limiting the scope of the forms disclosed herein.

Moreover, for stating or describing a numerical range, the phrase "in a range of between about a first numerical value and about a second numerical value," is considered equivalent to, and means the same as, the phrase "in a range of from about a first numerical value to about a second numerical value," and, thus, the two equivalently meaning phrases may be used interchangeably.

It is to be understood that the various forms disclosed herein are not limited in their application to the details of the order or sequence, and number, of steps or procedures, and sub-steps or sub-procedures, of operation or implementation of forms of the method or to the details of type, composition, construction, arrangement, order and number of the system, system sub-units, devices, assemblies, sub-assemblies, mechanisms, structures, components, elements, and configurations, and, peripheral equipment, utilities, accessories, and materials of forms of the system, set forth in the following illustrative description, accompanying drawings, and examples, unless otherwise specifically stated herein. The apparatus, systems and methods disclosed herein can be practiced or implemented according to various other alternative forms and in various other alternative ways.

It is also to be understood that all technical and scientific words, terms, and/or phrases, used herein throughout the present disclosure have either the identical or similar meaning as commonly understood by one of ordinary skill in the art, unless otherwise specifically defined or stated herein. Phraseology, terminology, and, notation, employed herein throughout the present disclosure are for the purpose of description and should not be regarded as limiting.

Conventional wax tax stamp application progresses in a generally linear direction, such that a 2×5 pack carton may be conveyed under a distribution of ten heated applicators, which align with the packs below as well as with ten wax tax stamps disposed on a flexible sheet between them. The tax stamps are distributed on an unrolled portion of a tax stamp roll, and are aligned with the underlying packs. The heated applicators are forced into contact with the back or upper side of the flexible substrate of the tax stamp roll, and thereafter into heated contact with the ten packs below them, transferring ten wax tax stamps from the underside of the flexible substrate to ten individual packs. FIG. 1A is an illustration of a carton 100 of standard product packs 105 of width a and length b where the packs are arranged in a standard configuration, having tax stamps 110 applied on surfaces of the product packs.

While well established, this linear progression of tax stamping does not work well for product packs which are odd-sized and/or oddly-arranged, or any other non-standard configuration which varies from the conventional arrangement of tax stamps on the rolls received from the taxing authorities. Thus, tobacco product distributors have been forced to use less efficient means of applying tax stamps to non-standard package configurations, even at times having to hand stamp each pack. Use of conventional automated tax stamping machines could result in misapplied stamps, skipped packs and/or wasted stamps left on the flexible roll substrate, due to misalignment of the applicator/stamp combination with the underlying product pack.

Figure 1B:
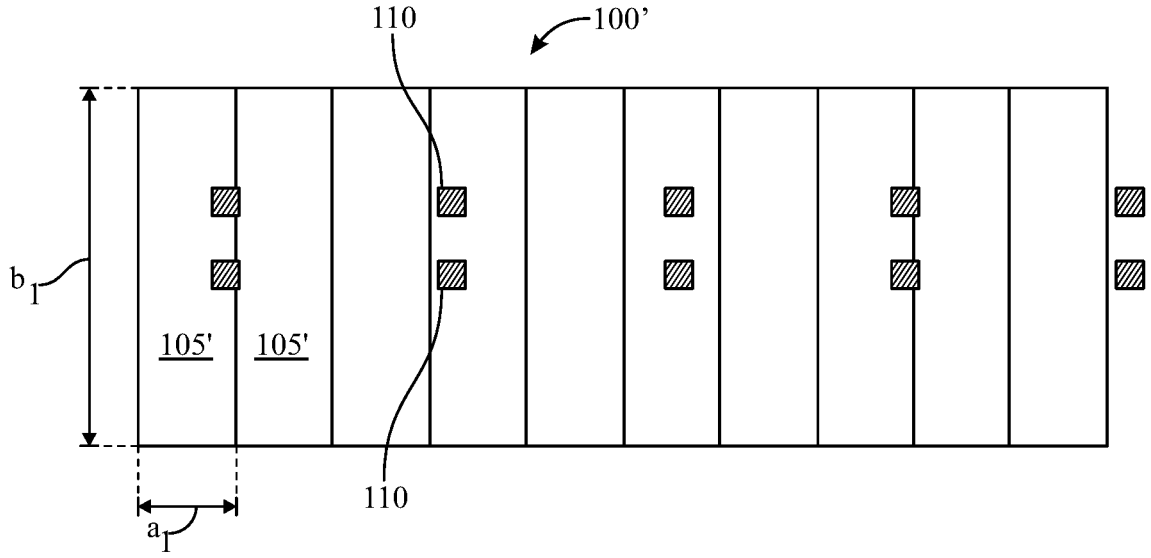
FIG. 1B presents an arrangement of non-standard packs.

FIG. 1B is an illustration of a non-standard arrangement 100' of non-standard size product packs 105', having width $a_1$ and length $b_1$, different from conventional width a and length b, the packs having a different orientation than in FIG. 1A, and tax stamps 110, which have been applied with a conventional tax stamping machine. The locations of the tax stamps in the packs are different in each pack, some of the tax stamps on the roll may overlap the individual product packs, multiple stamps may be applied on certain packs while other packs may be skipped and left without a stamp, and some stamps might never align properly, and be left on the roll.

For applications of the embodiments herein, grouping 100' of product packs 105' may be of a non-standard arrangement and/or may be a grouping of packs with non-standard sizes, but grouping 100' can also be a grouping of packs with standard sizes and/or standard arrangements (e.g., as shown in FIG. 1A). Grouping 100' of product packages 105' is not limited to any particular package sizes or particular grouping arrangements.

One or more embodiments of apparatuses and methods herein may be useful when a pattern arrangement of stamps on a stamp roll varies from a pattern arrangement of a grouping of product packages. One or more embodiments of apparatuses and methods herein may also be used for a pattern arrangement of stamps on a stamp roll that does not vary from a pattern arrangement of a plurality of product packages. In other words, while certain embodiments may be capable of movement to align stamps when the pattern of the stamps does not match the pattern of the package arrangement, certain embodiments may also be used whenever the patterns of the stamps and the packs do align.

According to certain embodiments herein, automated tax stamping onto product packs may be accomplished by automated independent control of the stamp roll carriage and/or the heated applicators relative to the packs. Using programmable logic or any other type of logic control to control machine components, certain embodiments may align at least one stamp applicator with at least one stamp and at least one underlying product pack, and apply tax stamps to packs in such a way that is not limited to the stamp arrangement pattern on the roll. Optionally, in certain embodiments, the conveyor underlying the stamp roll carriage, used to convey the product packs or cartons may also be controlled to align individual product packs with a stamp and a stamp applicator. In some embodiments, the logic controls may be programmed with various recipes for stamp application of different arrangements of product packs, and/or may be configured to recognize the product arrangement and apply the stamps accordingly. While application of tax stamps to product packs in a carton may be one use for embodiments disclosed herein, embodiments may also be used for application of any number of stamp-like indicia (or stickers) on other product packages requiring them.

In the description of the examples that follow, it should be understood that the x-direction and the y-direction are each arranged in a plane and orthogonal to one another. The z-direction is vertical and orthogonal to the x/y plane.

Referring now to FIGS. 2A through 2E, conventional tax stamp rolls 215 may be placed in a stamp roll carriage 200. In certain embodiments, roll carriage 200 may be structured and arranged for moving in the x- and/or y-directions relative to an arrangement 100' of product packages 105'. In certain embodiments, roll carriage 200 may not move. In certain embodiments, movement and alignment of the stamps in the y-direction relative to the packages 105' may be effectuated by unwinding and/or winding the roll of stamps 215. The roll of stamps 215 is provided on the stamp roll carriage 200 and may be unwound and/or wound on rollers 206 (shown in phantom) in the y-direction with control by way of motors 210. Heated stamp applicators 225 are mounted above an unwound portion of the tax stamp roll 215, for example in a second stamp applicator carriage 220. Stamp applicator carriage 220 may be static, or may move independently in the x- and/or y-direction relative to the arrangement 100' of product packages 105'. In certain embodiments, the stamp applicators 225 can be moveably mounted in the stamp applicator carriage 220, and/or moveably mounted within the stamp roll carriage 200, such as on a bar extending between the sides of the carriage 200, moveable in the x- and/or y-directions with motors, wires and/or pulleys. It should be understood that the stamp applicator(s) and/or stamp applicator carriage is also moveable in the z-direction to press and if necessary melt the stamp onto the underlying product package.

Figure 2A:
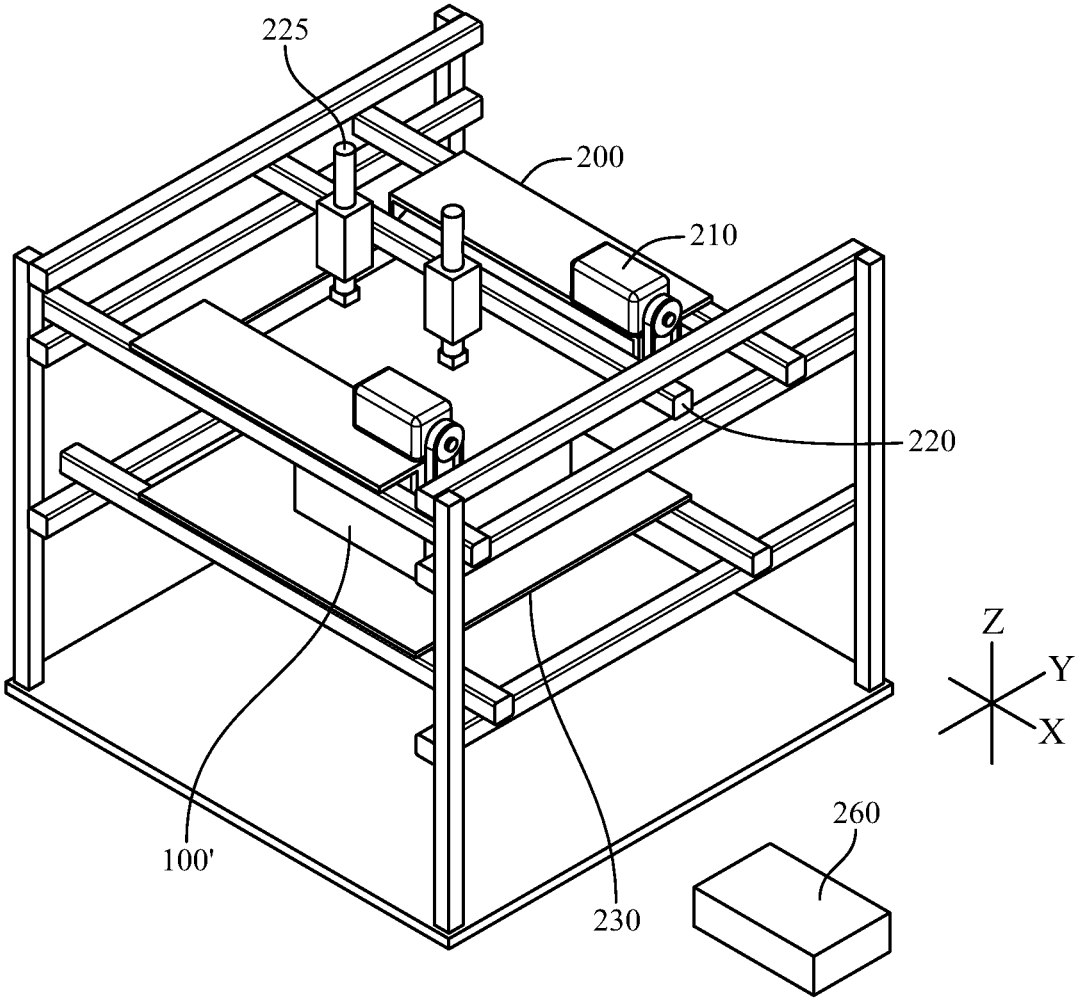
FIG. 2A presents a perspective view of an apparatus for stamping according to certain embodiments.
Figure 2B:
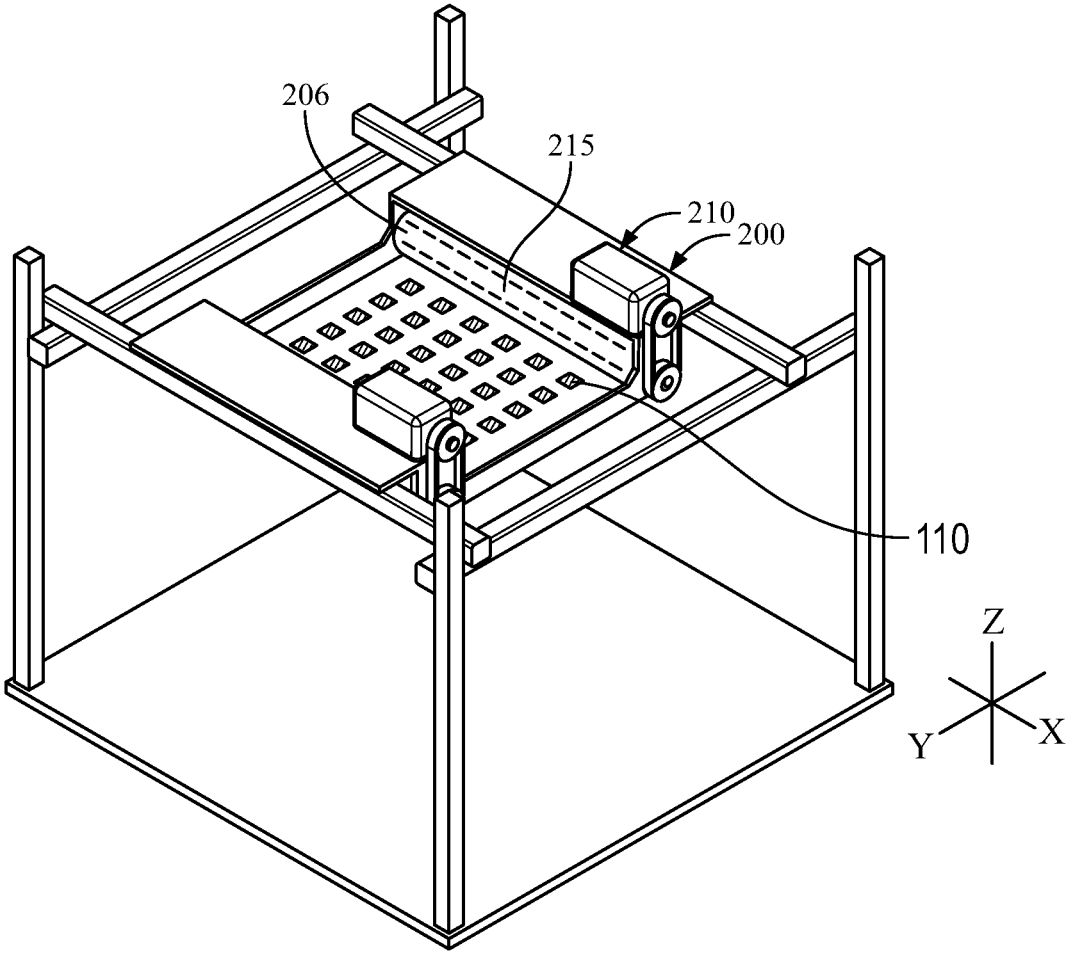
FIG. 2B presents an isolated view of a stamp roll carriage according to certain embodiments.
Figure 2C:
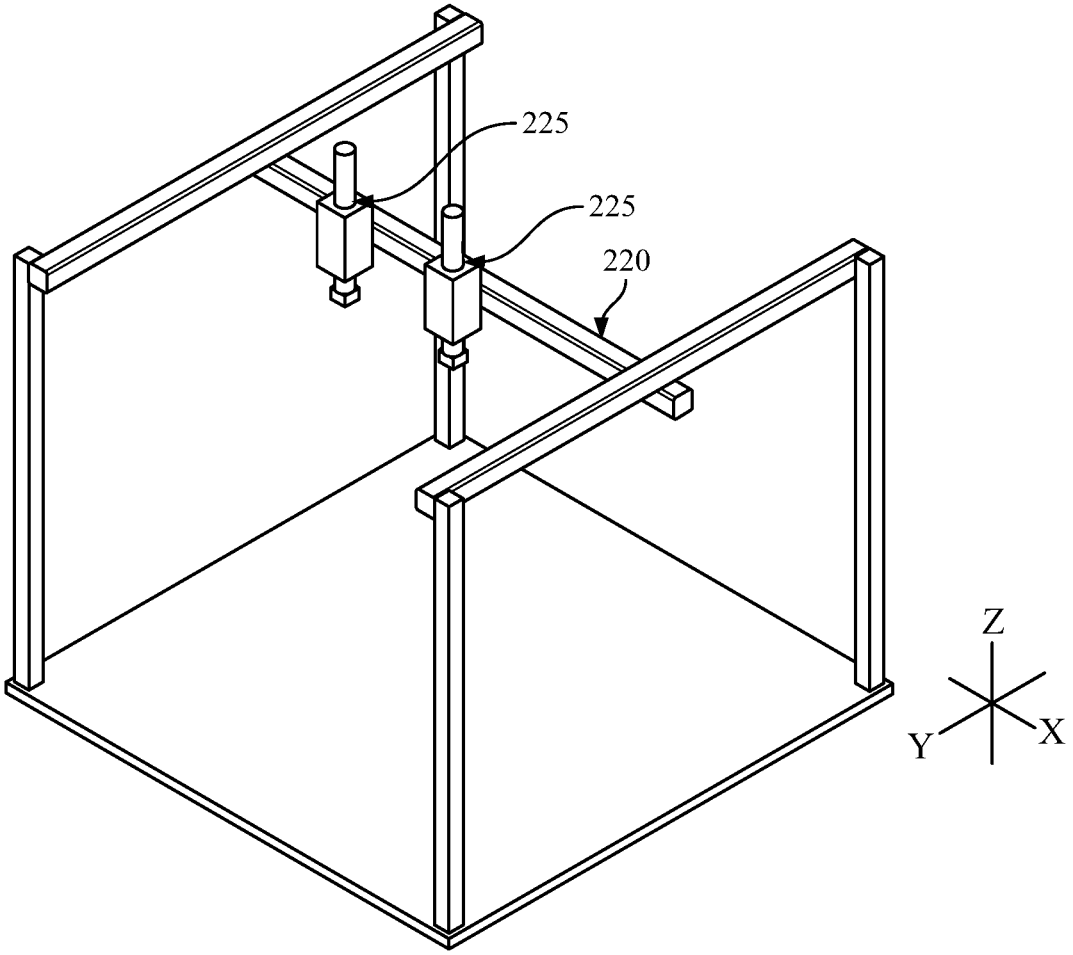
FIG. 2C presents an isolated view of a stamp applicator carriage according to certain embodiments.
Figure 2D:
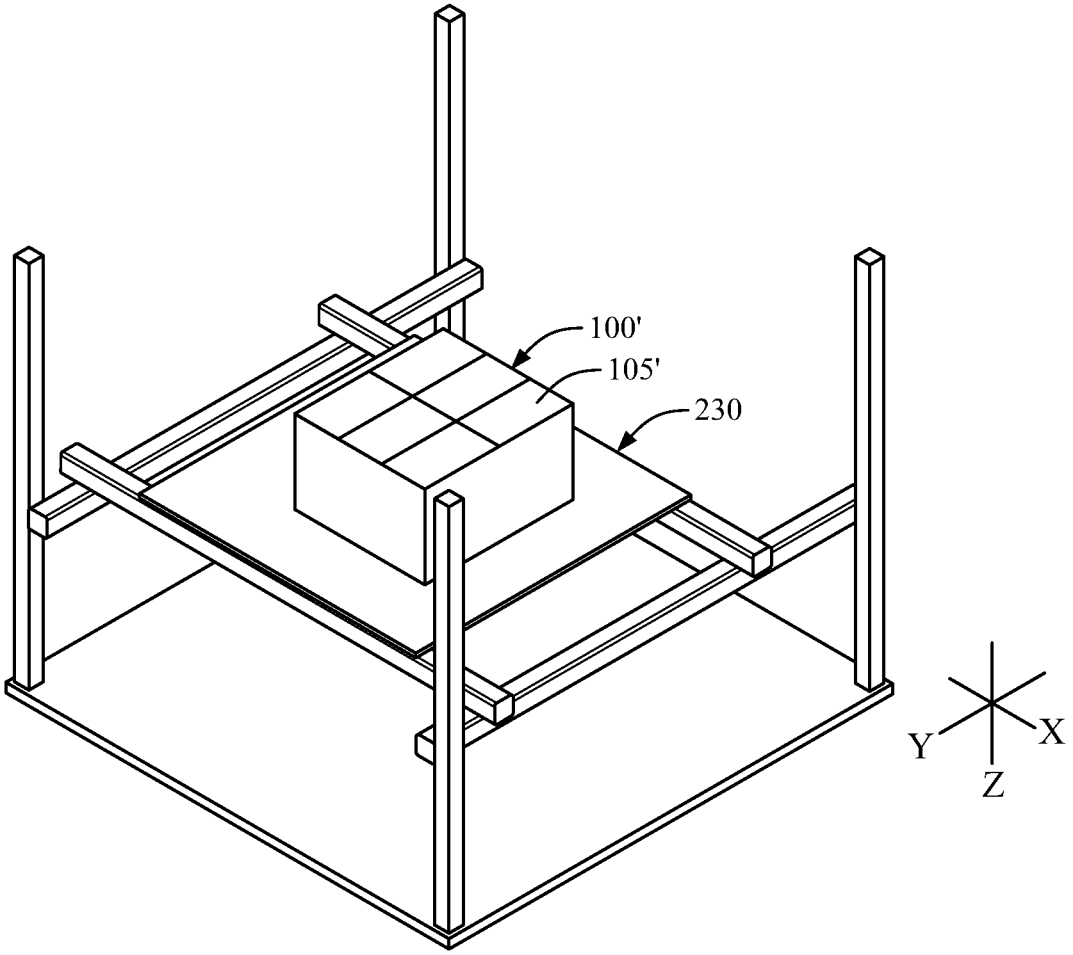
FIG. 2D presents an isolated view of a carriage for holding a grouping of packages according to certain embodiments.
Figure 2E:
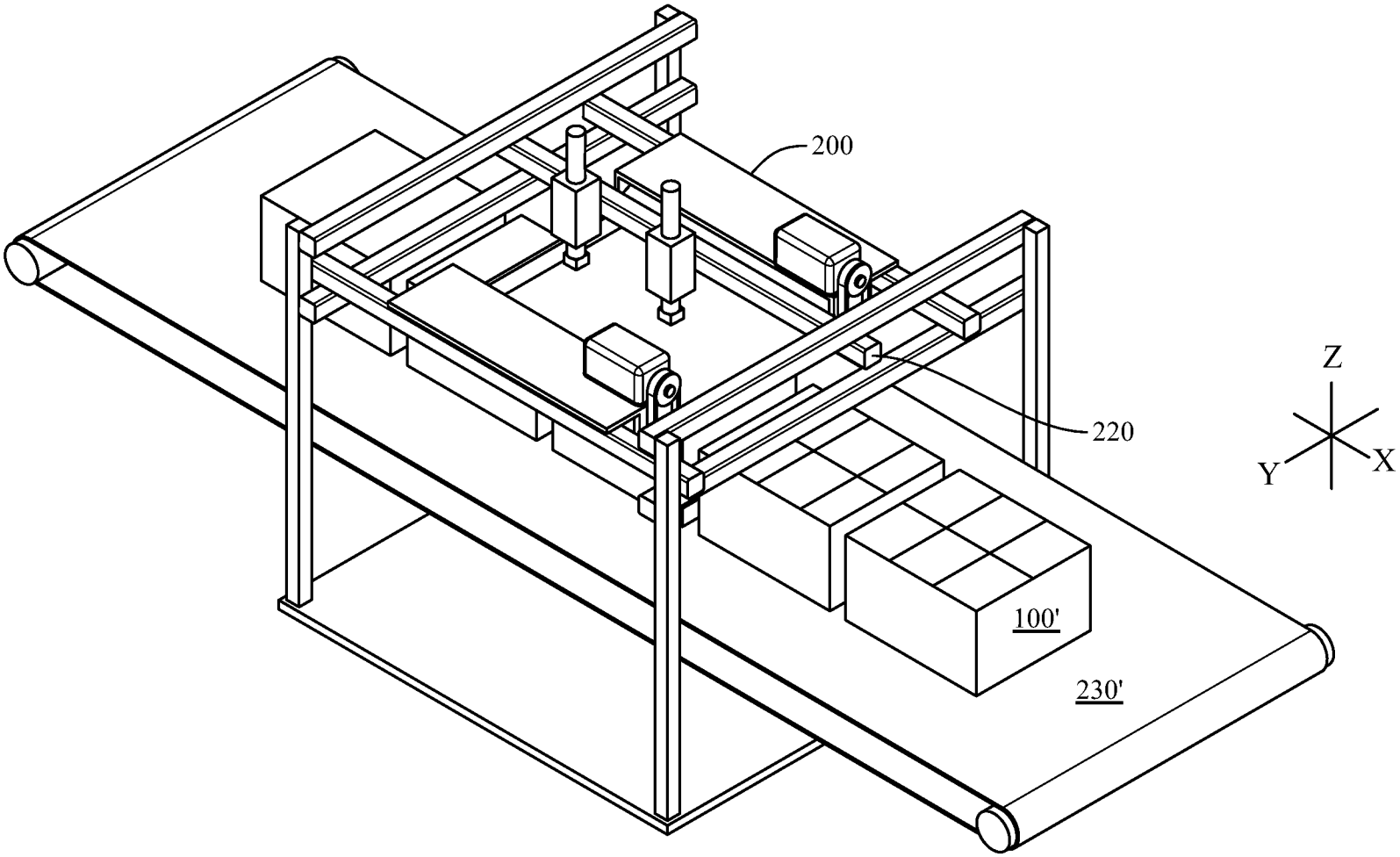
FIG. 2E is a perspective view of an apparatus for stamping according to certain embodiments.

The stamp applicator carriage 220 and optionally heated stamp applicator(s) 225 may be configured/adjusted/added or subtracted as required for specific carton configurations, including single, adjustable-position applicator configurations or multiple applicators at fixed dimensions. Arrangement 100' of product packages 105' may be positioned in the application area by placing it on a carriage 230, which may be static or may be movable along the x-axis and/or y-axis to align the packages until correct position is achieved. In one embodiment, the carriage 230 is a moveable table which is structured and arranged to move in the x- and/or y-directions. In certain embodiments, as shown in FIG. 2E, the container carriage is a conventional conveyor 230', which moves in the x-direction, and may assist in aligning the grouping 100' of packages 105'. For example, in certain embodiments, alignment in the y direction may be accomplished by winding and unwinding the roll of stamps 215 as described above, and alignment in the x direction may be achieved by moving the grouping 100' in a conveyor 230'. Certain embodiments, in addition or as an alternative, may involve movement in the x and/or y direction of a carriage 200, a carriage 220 and/or a carriage 230, and/or of stamp applicators 225.

In one or more embodiments, alignment of a stamp, a product package, and/or a stamp applicator may be accomplished through logic controlled positioning of the stamp roll carriage 200, the stamp applicator carriage 220, and/or the positioning of an available stamp using drive motors 210. The positions of all product packages in a grouping of packages, and/or the positioning of a stamp on an individual pack, may be programmed and stored as recipes in a programmable controller 260. Any number of recipes may be created and stored to accommodate any number of sizes for product packages and/or different configurations and arrangements of packages. Additionally, the recipe(s) may contain information on the positions of the stamps on the stamp rolls. The programmable controller 260 can use programmable logic or any other type of logic control to control machine components.

In one or more embodiments, the apparatus for affixing stamps unwound from a roll of stamps to a grouping of product packages comprises the following elements. A stamp roll carriage 200 with a feed roller and a take up roller 206 (one shown in phantom and one not shown) located on opposite ends thereof for holding the roll of stamps 215. A carriage 230 or 230' is provided below the stamp roll carriage for holding the grouping 100' of packages 105', and a stamp applicator 225 is located above a portion of unwound stamps 215. The stamp roll carriage 200, the carriage 230 or 230' and the stamp applicator 225, alone or in combination, are structured and arranged for alignment of at least one stamp on an unwound portion of the stamp roll in both x- and y-directions above and relative to at least one of the plurality of product packages, and the alignment occurs multiple times per grouping 100'. In certain embodiments, the stamp applicator 225 may be part of a stamp applicator carriage 220, and stamp applicator carriage 220 may, alone, or in combination with stamp roll carriage 200, the carriage 230 or 230' and/or the stamp applicator 225, be structured and arranged for alignment of at least one stamp on an unwound portion of the stamp roll in both x- and y-directions above and relative to at least one of the plurality of product packages.

Figure 3:
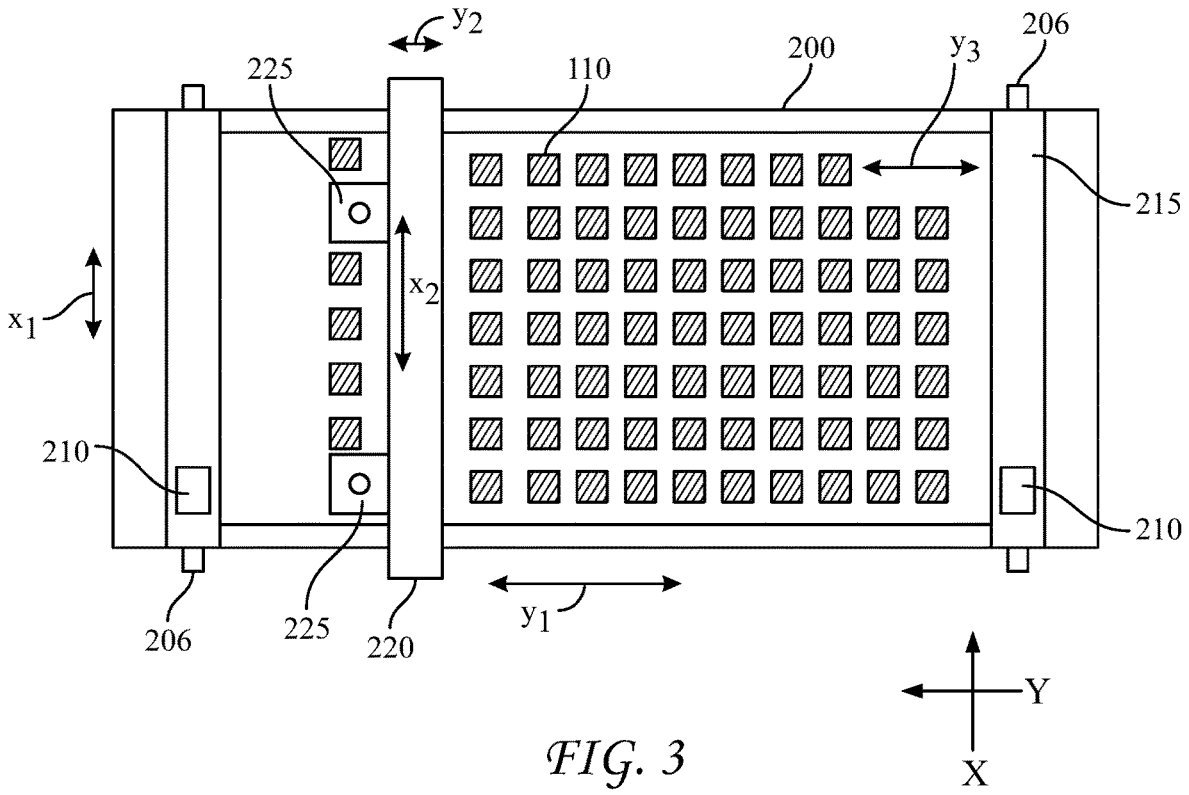
FIG. 3 presents an overhead view of an apparatus for stamping according to certain embodiments.

FIG. 3 shows an overhead view of an apparatus for tax stamping according to some embodiments. The stamp carriage 200 is illustrated as being moveable in directions $x_1$ and/or $y_1$, such that stamps 110 on an unwound portion of stamp roll 215 can be aligned both with at least one stamp applicator 225 and above an underlying product package (not shown). The stamp applicator(s) 225 can be mounted on a stamp applicator carriage 220, which is structured and arranged to move in directions $x_2$ and/or $y_2$, independently of underlying stamp roll carriage 200. In certain embodiments, stamp applicator(s) 225 may be separately movable in the x and/or y directions within stamp applicator carriage 220. By incorporating one or two motors 210 for the stamp roll 215, the individual stamps 110 on the unwound portion of the stamp roll can be moved in direction $y_3$, adding another option for alignment.

The alignment acts to align a stamp above a product package in a grouping of packages, within a container like a carton or a jig that holds the grouping in place or outside a container (for example, a set of packages may be simply grouped together for stamping but may not be inside a carton), for application of the stamp to the product package. It will be clear that a number of different possible alignment steps can be practiced by embodiments of the present application.

In another form is disclosed an apparatus for affixing stamps to a plurality of product packages within a first container. The apparatus has a stamp roll carriage having first and second rollers (a feed roller and a take-up roller) located on opposite ends thereof to accommodate a conventional roll of stamps, which are supplied as a two-dimensional array of stamps on a rolled flexible substrate and deposited in a first predetermined pattern. The stamp roll carriage is moveable in an x- and/or y-direction and at least one of the rollers is motorized. The apparatus further has a container carriage below the stamp roll carriage, which is structured and arranged to move a container containing a first plurality of product packages, which packages are arranged in a second pattern different than the first predetermined pattern of the stamps. The product packages move beneath the roll of stamps in the x- and/or y-direction and a stamp applicator carriage located above the stamp roll carriage and having at least one stamp applicator affixed thereto is provided. The stamp applicator carriage is moveable in the x- and/or y-direction, independently of the stamp roll carriage and/or container carriage. A programmable controller is programmed to control the position(s) of at least one of the carriages in the x- and/or y-direction is provided, such that the at least one stamp applicator is aligned above a stamp on an unwound portion of the roll of stamps and the stamp is aligned above at least one of the plurality of product packages, as described in detail above.

Another embodiment is directed to a method of applying stamps to a plurality of product packages within a container, including the steps of:

i) placing a roll of stamps which are deposited on a lower surface of a flexible substrate in a first predetermined pattern between motorized rollers on opposite ends of a stamp roll carriage structured and arranged for reversible movement in x- and/or y-directions, ii) placing a container containing a plurality of product packages arranged in a second pattern different than the predetermined pattern of the stamps beneath an unwound portion of the roll of stamps, iii) aligning at least one of the stamps above a top surface of at least one of the product packages, iv) aligning at least one stamp applicator above the at least one stamp, v) contacting an upper surface of the flexible substrate above the at least one stamp with the at least one stamp applicator to press the at least one stamp into contact with the top surface of the at least one package to apply the stamp to the top surface of the product package, and vi) repeating steps iii) to v) for additional product packages.

Specific forms will now be described further by way of example. While the following examples demonstrate certain forms of the subject matter disclosed herein, they are not to be interpreted as limiting the scope thereof.

PCT1. An apparatus for affixing stamps unwound from a roll of stamps to a grouping of product packages, comprising a first carriage with a pair of rollers for holding said roll of stamps, a second carriage below said first carriage for holding said grouping of product packages, and a stamp applicator located above a portion of said unwound stamps, wherein said first carriage, said second carriage and said stamp applicator, alone or in combination, are structured and arranged to enable alignment of at least one stamp of the unwound portion of the roll of stamps in both x- and y-directions above and relative to at least one product package of said grouping of product packages, additional alignments occurring multiple times per grouping.

PCT2. The apparatus of paragraph PCT1, wherein said alignment acts to align the at least one stamp above the at least one product package in the grouping for application of said stamp to said product package.

PCT3. The apparatus of paragraph PCT1 or PCT2, wherein the first carriage is moveable in the y-direction and the second carriage is moveable in the x-direction, or wherein first carriage is moveable in the x-direction and the pair of rollers on the first carriage are structured and arranged to wind and unwind the roll of stamps to move the stamps in the y-direction, or wherein said first carriage is moveable in the x-direction and/or y-direction, or wherein said second carriage is moveable in the x-direction and/or y-direction.

PCT4. The apparatus of any preceding PCT paragraph, wherein the pair of rollers on the first carriage is structured and arranged to wind and unwind the roll of stamps to move the stamps in the y-direction and the second carriage is moveable in the x-direction.

PCT5. The apparatus of any preceding PCT paragraph, wherein the stamp applicator is provided on a third carriage which is moveable in the x-direction and/or y-direction.

PCT6. The apparatus of any preceding PCT paragraph, wherein the stamp applicator is moveable in the x direction.

PCT7. The apparatus of any preceding PCT paragraph, wherein a pattern of said stamps on said roll varies from a pattern of said grouping of product packages.

PCT8. The apparatus of any preceding PCT paragraph, wherein a pattern of said stamps on said roll varies from a pattern of said grouping of product packages.

PCT9. The apparatus of any preceding PCT paragraph, further comprising a controller programmed to control the position of at least one of said carriages and said stamp applicator in the x-direction and/or y-direction.

PCT10. The apparatus of any preceding PCT paragraph, wherein the grouping of product packages is inside a container or not inside a container.

PCT11. The apparatus of any preceding PCT paragraph, wherein the second carriage is a conveyor that moves the grouping of product packages in the x-direction.

PCT12. The apparatus of any preceding PCT paragraph, wherein the first carriage has first and second rollers to accommodate the roll of stamps, said roll of stamps comprising a two-dimensional array of stamps on a rolled flexible substrate in a first predetermined pattern, said first carriage moveable in an x-direction and/or y-direction, the second carriage is below the first carriage, the second carriage structured and arranged to move said first grouping of product packages in the x-direction and/or y-direction, and wherein the grouping of packages are arranged in a second pattern different than the first predetermined pattern of said stamps, a third carriage located above the first carriage and having at least one stamp applicator affixed thereto, said third carriage moveable in the x-direction, y-direction and/or z-direction, and a controller programmed to control the position of at least one of said carriages in the x-direction and/or y-direction, such that the at least one stamp applicator is aligned above a stamp on an unwound portion of the roll of stamps and said stamp is aligned above at least one package of said grouping of product packages.

PCT13. The apparatus of any preceding PCT paragraph, wherein the roll of stamps is a roll of wax tax stamps.

PCT14. The apparatus of any preceding PCT paragraph, wherein said first and second rollers are both motorized and the controller is further programmed to control said motorized rollers, so as to wind and unwind the roll of stamps to move the stamps in the y-direction.

PCT15. A method of applying stamps to a grouping of product packages, comprising the steps of i) placing a roll of stamps which are arranged on a lower surface of a flexible substrate in a first predetermined pattern between rollers on a first carriage that is structured and arranged for movement in the x-direction and/or y-direction, ii) placing a grouping of product packages arranged in a second pattern different than said predetermined pattern of said stamps beneath an unwound portion of said roll of stamps, iii) aligning at least one of said stamps on said unrolled portion above a top surface of at least one product package of said grouping of product packages, iv) aligning at least one stamp applicator above said at least one stamp, v) contacting an upper surface of said flexible substrate above said at least one stamp with said at least one stamp applicator to press the at least one stamp into contact with the top surface of said at least one product package to apply the stamp to the top surface of the product package, and vi) repeating steps iii) to v) for additional stamps and additional product packages of said grouping of product packages.

PCT16. The method of paragraph PCT15, wherein said stamp applicator is affixed to a second carriage and the stamp applicator or the second carriage is structured and arranged for movement in at least the x-direction, independently of said first carriage.

PCT17. The method of paragraph PCT15 or PCT16, further comprising programming a controller with a recipe including information regarding the first predetermined pattern and the second pattern, to align the at least one stamp applicator over the at least one stamp and to align the at least one stamp over the top surface of at the least one product package.

PCT18. The method of any of paragraphs PCT15 to PCT17, wherein the rollers are motorized and further comprising winding and unwinding said roll of stamps with said motorized rollers to move the stamps in the y-direction to enable the alignment of said at least one of said stamps above the top surface of the at least one package of said grouping of product packages.

PCT19. The method of any of paragraphs PCT15 to PCT18, further comprising moving said second carriage in the x-direction and/or y-direction, or moving said first carriage and said second carriage in the x- and/or y-directions, or moving the first carriage in the x-direction and/or y-direction to align said at least one stamp applicator above said at least one stamp, or moving the container in the x-direction and/or y-direction to align said at least one stamp above said at least one product package, or moving the first carriage in the x-direction and winding or unwinding the roll of stamps to move the stamps in the y-direction with the motorized rollers to enable the alignments of steps iii) and/or iv).

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and sub-combinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and sub-combinations that are directed to one of the disclosed inventions and are novel and non-obvious. Inventions embodied in other combinations and sub-combinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed:

1. An apparatus for affixing stamps unwound from a roll of stamps to a grouping of product packages, comprising:

a first carriage with a pair of rollers for holding said roll of stamps;

a second carriage below said first carriage for holding said grouping of product packages; and a stamp applicator located above a portion of said unwound stamps;

wherein said first carriage, said second carriage and said stamp applicator, alone or in combination, are configured to enable alignment of at least one stamp of the unwound portion of the roll of stamps in both x- and y-directions above and relative to at least one product package of said grouping of product packages, additional alignments occurring multiple times per grouping, and wherein the stamp applicator is provided on a third carriage which is moveable in the x-direction and/or y-direction.

2. The apparatus of claim 1, wherein said alignment acts to align the at least one stamp above the at least one product package in the grouping for application of said stamp to said product package.

3. The apparatus of claim 1, wherein the first carriage is moveable in the y-direction and the second carriage is moveable in the x-direction.

4. The apparatus of claim 1, wherein the pair of rollers on the first carriage is configured to wind and unwind the roll of stamps to move the stamps in the y-direction and the second carriage is moveable in the x-direction.

5. The apparatus of claim 1, wherein first carriage is moveable in the x-direction and the pair of rollers on the first carriage are configured to wind and unwind the roll of stamps to move the stamps in the y-direction.

6. The apparatus of claim 1, wherein said first carriage is moveable in the x-direction and/or y-direction.

7. The apparatus of claim 1, wherein said second carriage is moveable in the x-direction and/or y-direction.

8. The apparatus of claim 1, wherein the stamp applicator is moveable in the x direction.

9. The apparatus of claim 1, wherein a pattern of said stamps on said roll varies from a pattern of said grouping of product packages.

10. The apparatus of claim 1, further comprising a controller programmed to control the position of at least one of said carriages and said stamp applicator in the x-direction and/or y-direction.

11. The apparatus of claim 1, wherein the grouping of product packages is inside a container.

12. The apparatus of claim 1, wherein the grouping of product packages is not inside a container.

13. The apparatus of claim 1, wherein the second carriage is a conveyor that moves the grouping of product packages in the x-direction.

14. An apparatus for affixing stamps to a first grouping of product packages, comprising:

a first carriage having first and second rollers to accommodate a roll of stamps, said roll of stamps comprising a two-dimensional array of stamps on a rolled flexible substrate in a first predetermined pattern, said first carriage moveable in an x-direction and/or y-direction;

a second carriage below the first carriage, structured and arranged to move said first grouping of product packages in the x-direction and/or y-direction, and wherein the grouping of packages are arranged in a second pattern different than the first predetermined pattern of said stamps;

a third carriage, located above the first carriage and having at least one stamp applicator affixed thereto, said third carriage moveable in the x-direction, y-direction and/or z-direction; and a controller programmed to control the position of at least one of said carriages in the x-direction and/or y-direction, such that the at least one stamp applicator is aligned above a stamp on an unwound portion of the roll of stamps and said stamp is aligned above at least one package of said grouping of product packages.

15. The apparatus of claim 14, wherein the roll of stamps is a roll of wax tax stamps.

16. The apparatus of claim 14, wherein said first and second rollers are both motorized and the controller is further programmed to control said motorized rollers, so as to wind and unwind the roll of stamps to move the stamps in the y-direction.

17. The apparatus of claim 14, wherein the at least one stamp applicator is a heated applicator structured and arranged to contact a top surface of the rolled flexible substrate and melt a wax stamp located on a bottom surface of the rolled flexible substrate onto a surface of said at least one package of said grouping of product packages.

18. The apparatus of claim 14, comprising more than one of said stamp applicators affixed to said third carriage.

19. The apparatus of claim 14, wherein the controller is further programmed to control said second carriage to move a second grouping of packages beneath said roll of stamps upon completion of stamping said first grouping of product packages.

20. The apparatus of claim 14, wherein both of said rollers are motorized and are located on the opposite ends of said first carriage in the y-direction.

21. The apparatus of claim 14, wherein said second carriage is a conveyor which moves said grouping of product packages in the x-direction below the first carriage.

22. The apparatus of claim 14, wherein the grouping of product packages is inside a container.

23. The apparatus of claim 14, wherein the grouping of product packages is not inside a container.

24. A method of applying stamps to a grouping of product packages, comprising:

i) placing a roll of stamps on a lower surface of a flexible substrate in a first predetermined pattern between rollers on a first carriage that is structured and arranged for movement in the x-direction and/or y-direction;

ii) placing a grouping of product packages arranged in a second pattern different than said predetermined pattern of said stamps beneath an unwound portion of said roll of stamps;

iii) aligning at least one of said stamps on said unrolled portion above a top surface of at least one product package of said grouping of product packages;

iv) aligning at least one stamp applicator above said at least one stamp;

v) contacting an upper surface of said flexible substrate above said at least one stamp with said at least one stamp applicator to press the at least one stamp into contact with the top surface of said at least one product package to apply the stamp to the top surface of the product package; and vi) repeating steps iii) to v) for additional stamps and additional product packages of said grouping of product packages, wherein said stamp applicator is affixed to a second carriage and the stamp applicator or the second carriage is structured and arranged for movement in at least the x-direction, independently of said first carriage.

25. The method of claim 24, further comprising programming a controller with a recipe to align the at least one stamp applicator over the at least one stamp and to align the at least one stamp over the top surface of at the least one product package.

26. The method of claim 25, wherein said recipe includes information regarding the first predetermined pattern and the second pattern.

27. The method of claim 24, wherein the rollers are motorized and further comprising winding and unwinding said roll of stamps with said motorized rollers to move the stamps in the y-direction to enable the alignment of said at least one of said stamps above the top surface of the at least one package of said grouping of product packages.

28. The method of claim 24, further comprising moving said second carriage in the x-direction and/or y-direction.

29. The method of claim 24, further comprising moving said first carriage and said second carriage in the x- and/or y-directions to align said at least one stamp applicator above said at least one stamp.

30. The method of claim 24, further comprising moving the first carriage in the x-direction and/or y-direction to align said at least one stamp applicator above said at least one stamp.

31. The method of claim 24, further comprising moving the container in the x-direction and/or y-direction to align said at least one stamp above said at least one product package.

32. The method of claim 24, further comprising moving the first carriage in the x-direction and winding or unwinding the roll of stamps to move the stamps in the y-direction with the motorized rollers to enable the alignments of steps iii) and/or iv).

33. The method of claim 24, wherein the grouping of product packages is inside a container.

34. The method of claim 24, wherein the grouping of product packages is not inside a container.

35. The method of claim 24, wherein the grouping of product packages is moved in the x-direction by a conveyor to enable the alignment of step iii).

* * * * *